US008378278B2

(12) United States Patent
Ashkenazi

(10) Patent No.: US 8,378,278 B2
(45) Date of Patent: Feb. 19, 2013

(54) FOLDABLE AND DEPLOYABLE PANEL

(75) Inventor: Arie Ashkenazi, Haifa (IL)

(73) Assignee: Elbit Systems Ltd., Haifa (IL)

( * ) Notice: Subject to any disclaimer, the term of this patent is extended or adjusted under 35 U.S.C. 154(b) by 377 days.

(21) Appl. No.: 12/867,364

(22) PCT Filed: Feb. 23, 2009

(86) PCT No.: PCT/IL2009/000204

§ 371 (c)(1),
(2), (4) Date: Aug. 12, 2010

(87) PCT Pub. No.: WO2009/107126

PCT Pub. Date: Sep. 3, 2009

(65) Prior Publication Data

US 2010/0314488 A1 Dec. 16, 2010

(30) Foreign Application Priority Data

Feb. 26, 2008 (IL) ..... 189785

(51) Int. Cl.
*F42B 15/01* (2006.01)

(52) U.S. Cl. ..... 244/3.27; 244/3.28; 244/3.29; 244/172.6

(58) Field of Classification Search ..... 244/3.24–3.29, 244/172.6, 3.1, 49, 39; 16/287, 366, 377
See application file for complete search history.

(56) References Cited

U.S. PATENT DOCUMENTS 3,063,375 A * 11/1962 Hawley et al. ..... 244/3.27
3,643,599 A 2/1972 Hubich
4,664,339 A 5/1987 Crossfield
4,667,899 A 5/1987 Wedertz
4,728,058 A * 3/1988 Brieseck et al. ..... 244/3.28
4,869,442 A * 9/1989 Miller ..... 244/3.28
5,108,051 A * 4/1992 Montet et al. ..... 244/3.28
5,326,049 A * 7/1994 Rom et al. ..... 244/3.28
5,520,747 A * 5/1996 Marks ..... 136/245
6,010,096 A * 1/2000 Baghdasarian ..... 244/172.6
6,168,116 B1 * 1/2001 Renshall et al. ..... 244/172.6
(Continued)

FOREIGN PATENT DOCUMENTS

EP 0318359 5/1989
EP 1628112 2/2006
(Continued)

OTHER PUBLICATIONS

International Search Report for PCT Application No. PCT/IL2009/000204 mailed Jul. 13, 2009.

*Primary Examiner* — Philip J Bonzell
(74) *Attorney, Agent, or Firm* — Sughrue Mion, PLLC

(57) ABSTRACT

A foldable deployable panel device (12) attached to a body (16) of an object is disclosed. The device includes a panel pivotally attached to the body by a first pivot element (40/42) at a first pivot position and a second pivot element (29) at a second pivot position. The first pivot element (40/42) is disengageable from the first pivot position, when the panel (12) is aligned in a predetermined orientation. The second pivot element (29) is fixed at the second pivot position, when the first pivot element (40/42) is engaged at the first pivot position. The panel (12) is urged by an energy storing element (28), when the first pivot element (40/42) is disengaged from the first pivot position, to move into a deployed position.

30 Claims, 5 Drawing Sheets

U.S. PATENT DOCUMENTS

| | | | | |
|---|---|---|---|---|
| 6,609,683 | B2 * | 8/2003 | Bauer et al. | 244/172.6 |
| 6,761,331 | B2 * | 7/2004 | Eisentraut et al. | 244/3.28 |
| 6,905,093 | B2 * | 6/2005 | Dryer et al. | 244/3.28 |
| 6,978,970 | B2 * | 12/2005 | Purcell, Jr. | 244/49 |
| 7,565,185 | B2 * | 7/2009 | Kang et al. | 455/575.3 |
| 7,642,492 | B2 * | 1/2010 | Parine et al. | 244/3.27 |
| 7,732,741 | B1 * | 6/2010 | Whitham | 244/3.27 |
| 7,919,740 | B2 * | 4/2011 | Feuerstein | 244/3.25 |
| 2003/0178527 | A1 * | 9/2003 | Eisentraut et al. | 244/3.28 |
| 2004/0144888 | A1 * | 7/2004 | Dryer et al. | 244/3.27 |
| 2009/0008496 | A1 * | 1/2009 | Feuerstein | 244/3.28 |

FOREIGN PATENT DOCUMENTS

| | | |
|---|---|---|
| WO | WO 8805898 | 8/1988 |

* cited by examiner

FOLDABLE AND DEPLOYABLE PANEL

CROSS-REFERENCE TO RELATED APPLICATIONS

This application is a National Phase Application of PCT International Application No. PCT/IL2009/000204, International Filing Date Feb. 23, 2009, claiming priority of Israel Patent Application 189785, filed Feb. 26, 2008, both of which are incorporated herein by reference in their entirety.

FIELD OF THE INVENTION

The present invention relates to foldable and deployable panels.

BACKGROUND OF THE INVENTION

Large protruding panels, in which the thickness-dimension is substantially smaller than the length and width dimensions, are key components in a large variety of technologies and objects where they are referred to as "panels". The term "panel" encompasses the terms "air foils", "plates", "fins", "wings" and other surfaces when used in the relevant context. Hereinafter the term "object" or "body" in the following text refers to devices to which panels are coupled.

Panels can vary in size and shape as well as having various spatial configurations, not necessarily flat in shape. Examples for the use of such elements are solar-panels for satellites, various types of broadcasting and reception antennas and the elevation and stabilization devices used in wings of space ships, rockets and projectiles of various kinds.

Panels are so designed as to bestow a relative large footprint to the objects they are part of. The larger the area and span of wings of aircrafts and rockets, the greater are their maneuverability and gliding abilities. The advantages of large footprint-feature in flight may cause disadvantages and difficulties in storing, transporting and deploying of panel-equipped objects.

Folding and deploying panels in two different axes are known and four relevant patents are listed below:

U.S. Pat. No. 4,664,339 (Crossfield) disclosed a missile appendage deployment mechanism for receipt on the side of a missile or projectile and in a stowed position. The mechanism including a wing or fin which is designed, when deployed, to rotate upwardly from the stowed position into a feathered vertical position into the airstream of the missile. The wing moves upwardly from the horizontal stowed position into the vertical feathered position in a continuous smooth motion.

U.S. Pat. No. 4,869,442 (Miller) disclosed a self-deploying airfoil mounted on the body of a device such as an artillery shell projectile and folded down and forward with respect to the relative airstream. The airfoil is attached to a yoke by a pivot pin. The yoke shaft is pivoted in the body in a manner to allow it to pivot 90 degrees tangentially with respect to the body. The airfoil assembly may be retained by a cover which is removable to deploy the airfoil. The shaft of the yoke is mounted at a small angle to the axis of the body so that the airfoil has an angle of attack relative to the airstream when it pivots tangentially outward. When the cover is removed, a spring starts the airfoil rotating out into the airstream where drag drives it to the 90 degree position. The yoke is locked in the 90 degree position by a yoke lock pin. The airfoil, which is rigidly attached by pins to the pivot pin, cannot begin to rotate about the pivot pin until the yoke has rotated 90 degrees. A flat on the head of the pivot pin rides on the surface of the body preventing rotation in a vertical direction until the 90 degrees of tangential rotation has been completed. Aerodynamic lift acting on the airfoil then rotates it upward to a position about normal to the body axis where it is locked by an airfoil lock pin.

U.S. Pat. No. 5,326,049 (Rom et al.) described a wing, normally folded in an inoperative position and to be unfolded to an operative position when the body is accelerated in the direction of the longitudinal axis of the body. The appendage is pivotally mounted about a first pivot axis extending perpendicularly to the longitudinal axis of the body, and also about a second pivot axis extending parallel to the longitudinal axis of the body. The center of gravity of the appendage is outwardly of the first pivot axis in the folded condition of the appendage such that the acceleration of the body produces a moment pivotting the appendage about the first pivot axis.

WO8805898 (Eskam et al.) disclosed a finned projectile or missile having a housing with a longitudinal axis and several fins hinged thereon which in their deployed position are prestressed by springs in a position perpendicular to the longitudinal axis. To allow the fins to occupy as little space as possible in their folded position, but to supply a symmetrical lift in their deployed position, as in the case of blade-like fins, each fin has at its base an articulated pin inclined towards the longitudinal axis of the fin and is rotatably secured in a bore of the housing so as not to fall off, the bore being matchingly inclined towards the radial plane of the housing. On the outer side of the housing in the region of each bore, a cavity allowing the pivoting deployment of a corresponding fin is arranged, limited by a stopping shoulder for the fin which maintains said fin in a perpendicular position with respect to the longitudinal axis.

SUMMARY OF THE INVENTION

There is thus provided, in accordance with some embodiments of the present invention, a foldable deployable panel device attached to a body of an object, the device comprising:

a panel pivotally attached to the body by a first pivot element at a first pivot position and a second pivot element at a second pivot position, wherein the first pivot element is disengageable from the first pivot position, when the panel is aligned in a predetermined orientation, and wherein the second pivot element is fixed at the second pivot position, when the first pivot element is engaged at the first pivot position, and wherein the panel is urged by an energy storing element, when the first pivot element is disengaged from the first pivot position, to move into a deployed position.

Furthermore, according to embodiments of the present invention, the energized element comprises a spring.

Furthermore, according to embodiments of the present invention, the spring is connected at one end to the second pivot element and at another end to the body.

Furthermore, according to embodiments of the present invention, the second pivot element fits into a matching bore when engaged in the second pivot position.

Furthermore, according to embodiments of the present invention, the matching bore is provided in a support member comprising two plates in between which a portion of the panel is located when in the deployed state.

Furthermore, according to embodiments of the present invention, a support member is provided for supporting the panel in the deployed state.

Furthermore, according to embodiments of the present invention, the support member comprises two substantially parallel plates projecting from the body, confining a proximal portion of the panel.

Furthermore, according to embodiments of the present invention, the support plates comprise inclined top edges.

Furthermore, according to embodiments of the present invention, the panel is selected from a group of panels including: a wing, a solar panel, an antenna.

Furthermore, according to embodiments of the present invention, the device is further provided with a fastener for fastening the panel to the body.

Furthermore, according to embodiments of the present invention, the fastener is provided with a release mechanism.

Furthermore, according to embodiments of the present invention, the release mechanism is selected from a group of release mechanisms including: time-dependent mechanism, remote-controlled mechanism, time-delay mechanism.

Furthermore, according to embodiments of the present invention, the device further comprises a locking mechanism for locking the panel in a deployed state.

Furthermore, according to embodiments of the present invention, the locking mechanism comprises a snap-lock.

Furthermore, according to embodiments of the present invention, there is provided a projectile or flying object comprising:

a body;

a plurality of panels, each panel pivotally attached to the body by a first pivot element at a first pivot position and a second pivot element at a second pivot position, wherein the first pivot element is disengageable from the first pivot position, when the panel is aligned in a predetermined orientation, and wherein the second pivot element is fixed at the second pivot position, when the first pivot element is engaged at the first pivot position, and wherein the panel is urged by an energy storing element, when the first pivot element is disengaged from the first pivot position, to move into a deployed position.

Furthermore, according to embodiments of the present invention, the object is provided with a container for storing the object when the panels are in a folded storing state.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

An embodiment of the present invention is depicted in the accompanying figures. The panel in this example is a wing of a projectile. However the present invention is not limited to wings and other panels, for example, solar panels, antennas, are also covered by the scope of the present invention as it is defined by the appended claims and their equivalents.

DETAILED DESCRIPTION OF EMBODIMENTS

Figure 1:
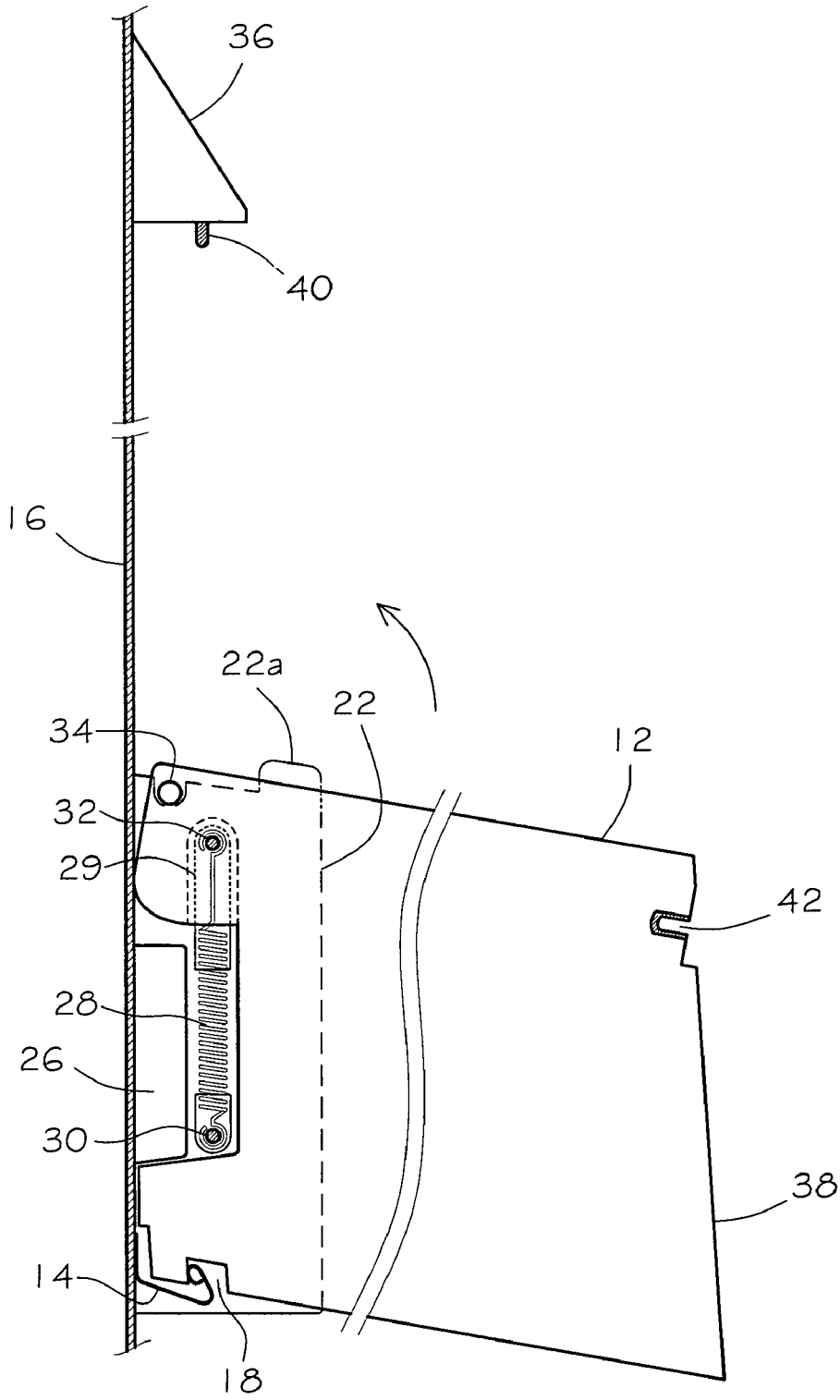
FIG. 1 is an illustration of a foldable deployable wing in accordance with an embodiment of the present invention with the wing locked in a deployed position.

To exemplify the use of the mechanism for reversibly folding and deploying panels in accordance with an embodiment of the present invention the folding and deployment of wings of projectiles and other flying devices are detailed hereinafter.

It is an object of the present invention to provide a foldable and deployable panel that is capable of easy and swift deployment.

Another object of the present invention is to provide a foldable deployable panel, which can be folded neatly and stored in a confined space comparable in its size to the main body to which the panel is attached, thus reducing substantially storage footprint required for main-body having the wing attached.

Other objects and advantages of the present invention when used for the folding and deployment of panels in various usages will become apparent after reading the present specification and reviewing the accompanying figures.

The present invention improves the efficiency of compaction and reduction of packaging volume required for reversibly foldable and deployable panels. The folding (and reversibly, the deployment) is done by two consecutive turns that bring the panels to a "wrapping" posture along side the object to which it is coupled. An explanation of the deployment and folding of panels in accordance with the present invention follows:

From a folded state an electronic command-signal, a pyrotechnical-mechanism or some other triggering mechanism commences the deployment of panels in accordance with the present invention. The triggering command releases a locking mechanism. The released panels swirl so as to be positioned perpendicularly to the object to which they are connected. Next, by "stored energy" originating from either a spring, a hydraulic-piston or a pneumatic mechanism connected to a pressured gas source or a gas-generator, the panels are swirled once again by 90 degrees in perpendicular direction and are inserted into a stabilizing slot between two protective plates. The panels can now be locked in place in either a permanent locking arrangement or a locking arrangement that permits the refolding of the panels.

By way of example detailed elaboration of a embodiment of the present invention is given hereinafter, where the panels are wings of a projectile or other flying object.

Wings serve as aerodynamic surfaces providing lift to a flying object. To be effective wings typically span a substantial distance from the body of projectile thus bestowing a large footprint. The footprint dictates large packaging, storage and maintenance volumes. Foldable wings were introduced, and can be seen, for example on aircraft parked on aircraft carrier decks. The need for parking room is met by reducing the wing span of parked aircraft on board aircraft carriers. But when a substantial portion of the wing folded to an up-right position, the space freed on the sides of the aircraft is replaced with occupied space over the aircraft, a space which on the upper deck of an aircraft carrier is abundant. If a winged object is to be stored in on a confined space the wing span may pose a true problem.

As the length of a wing is usually greater than its width, folding it across results in either shortening the wing by as much as half (in the case of about 180 degrees fold), or having the wind protrude upwards (in the case of about 90 degrees fold).

The present invention introduces a wing of a projectile which can be folded in a twin-action sequence. A first action brings the elongated aspect of the wing to a substantially parallel position along the adjacent body to which it is attached, to a side-by-side configuration with the body, and a second action in which the now side-by-side wing is turned about an axis parallel to the adjacent body, bringing the broad surface of the wing to a tangential stored position with respect to the body external surface.

By doing so the footprint of the wing is greatly reduced, allowing for minimal space storage.

When deploying the wing from the stored position the above sequence of actions is performed in reverse order, bringing the wing to the deployed position.

According to an embodiment of the present invention, a wing is disclosed that can be easily and swiftly deployed from the folded state and remain fixed in the deployed position.

By "projectile" is meant, for the purpose of the present invention and throughout this specification (unless specifically stated otherwise) any object that is ejected, thrown, tossed, propelled, shot, dropped, flown or otherwise dispatched to make its way in air, be it aerodynamically, free falling or any other way of travel in air.

In some embodiments of the present invention the body with the folded wing is stored in a container which holds the folded wing to the body of the object.

In some embodiments of the present invention the folded wing is fastened to the body of the object by a fastener and a controlled release mechanism removes the fastener to allow immediate deployment of the wing.

Reference is now made to the figures:

FIG. 1 is an illustration of a foldable deployable wing 12 in accordance an embodiment of the present invention with the wing locked in a deployed position by a flexible snap-lock mechanism 14 in a substantially vertical, perpendicular deployed position, relative to the outer surface of projectile 16. FIG. 1 should be viewed in conjunction with FIG. 5 which illustrates a lateral cross-section illustration across the wing folding and deploying device in accordance an embodiment of the present invention with wing 12 in a deployed position. Shown in FIG. 1 is snap-lock 14 snapped into gap 18 in wing 12 in a region close to the surface of the projectile 16, in a flight configuration. Two parallel support plates, 20 and 22 (only 20 is visible in FIG. 1, both shown in FIG. 5) protrude from the surface of the projectile 16 and confine a proximal portion of the wing (close to the projectile body) between them. Support plates 20, 22, serve as reinforcement members while snap-lock 14 and spring 28, elastically hold the wing down. Spring 28 rests on stand 26 which is a plate located in between support plates 20 and is secured at one end to pin 30 that runs substantially parallel to the plates, and at the other end to anchoring point 32 which is connected to wing 12. A pin 29 is connected to the end of spring 28, and is coupled to anchoring point 32. Pin 29 serves as a pivot when spring 28 is stretched and wing 12 is pulled from between support plates 20 and 22 (shown in FIG. 2 and explained hereinafter).

Figure 2:
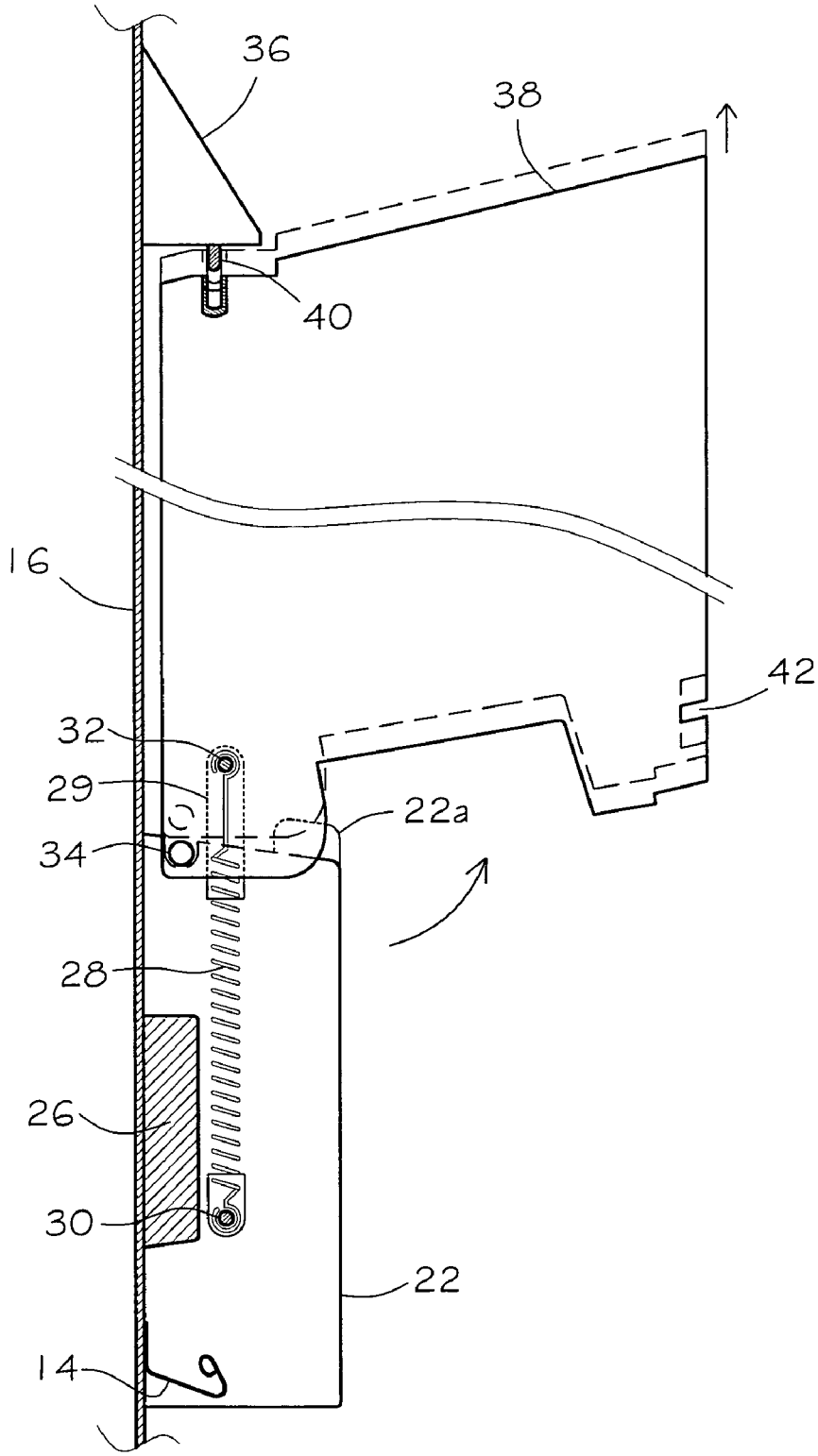
FIG. 2 is an illustration of the foldable deployable wing shown in FIG. 1 with the wing unlocked and turned so as to align with the adjacent body.

FIG. 2 is an illustration of the foldable deployable wing shown in FIG. 1 with the wing unlocked and turned so as to align with the adjacent body 16. In the Figure wing 12 is unlocked from the snap-lock 14 and rotated sideway in the direction-of-flight of the projectile utilizing peg 34 as a pivot, bringing it to a side-by-side alignment with the adjacent object 16. The wing is pulled to bring its distal edge 38 towards auxiliary flap 36 so that docking pin 40, extending from the auxiliary flap is inserted and fixed in corresponding bore 42, defining a hinge. With the pulling of the wing spring 28 is stretched and pin 29 at the end of the spring serves as a pivot. With the wing pulled from between the support plates 20 and 22 the wing is free to turn side way on the defined hinge between docking pin 40 and pin 29.

Figure 3:
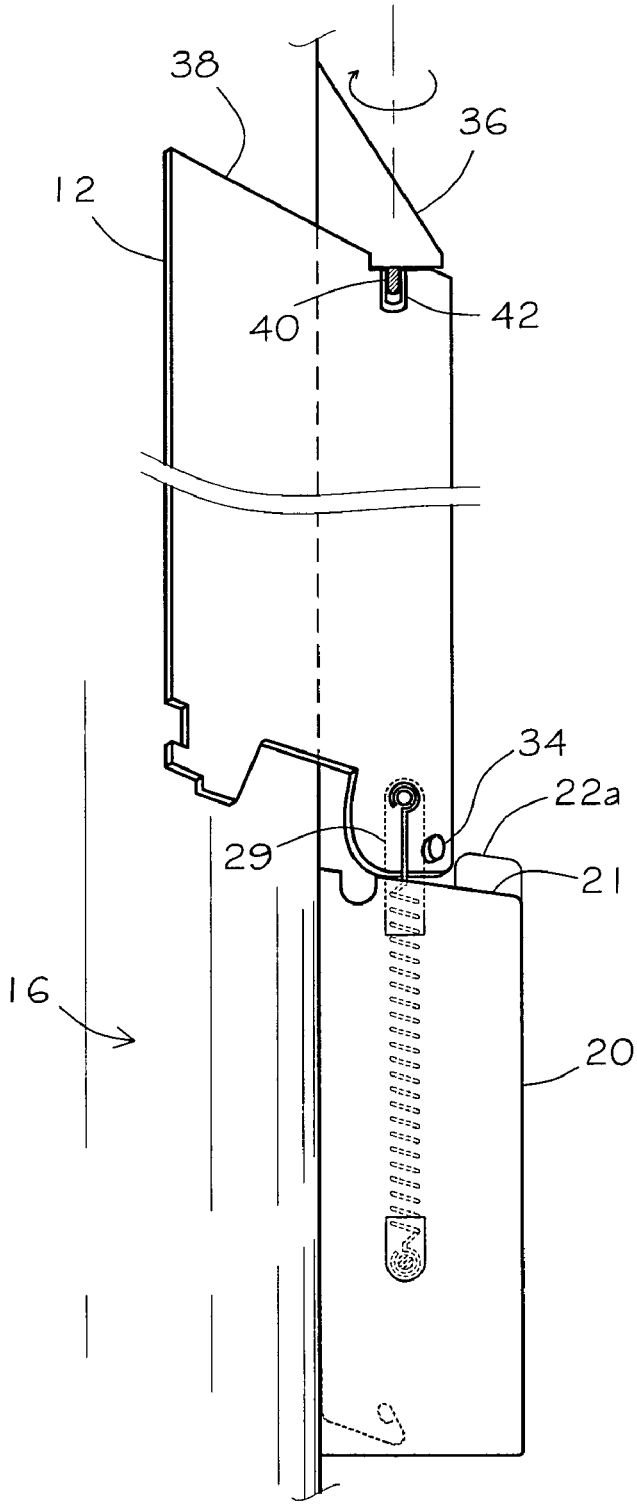
FIG. 3 is an illustration of the foldable deployable wing shown in FIG. 1 and FIG. 2 with the wing pulled towards the docking pin of an auxiliary flap and turned towards the adjacent body.

FIG. 3 is an illustration of wing 12 turned towards the body of projectile 16 on the hinge explained in FIG. 2. The inclined edge 21 of support plate 22 (one of the two support plates) has a protrusion 22A, distanced from the body of the projectile. Protrusion 22A, illustrated in a lateral cross-section illustration in FIG. 4 and FIG. 5, limits the angular movement of wing 12 to a single, predetermined, folding side towards the body of the projectile when removed from between support plates 20 and 22 and stops the wing from damaging the body of the projectile 16 when folded (prevents "over folding".

Figure 4:
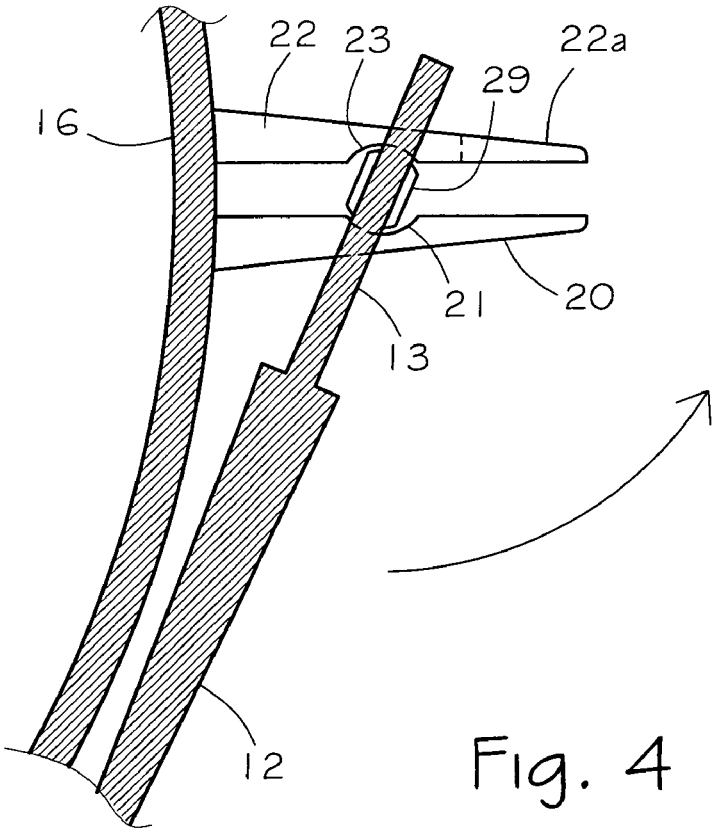
FIG. 4 is a lateral cross-section illustration of the foldable deployable wing illustrated in FIG. 3.

FIG. 4 is a lateral cross-section illustration of the foldable deployable wing 1 illustrated in FIG. 3. showing the wing in a folded state, stretched out of the support of support plates 20 and 22. Note that a portion of wing 12 adjacent the body 16 is thinner than the rest of the wing so as to fit that portion of the wing within the support plates 20 and 22, while presenting a substantially aligned outer surface of the support plates and the rest of the wing.

Figure 5:
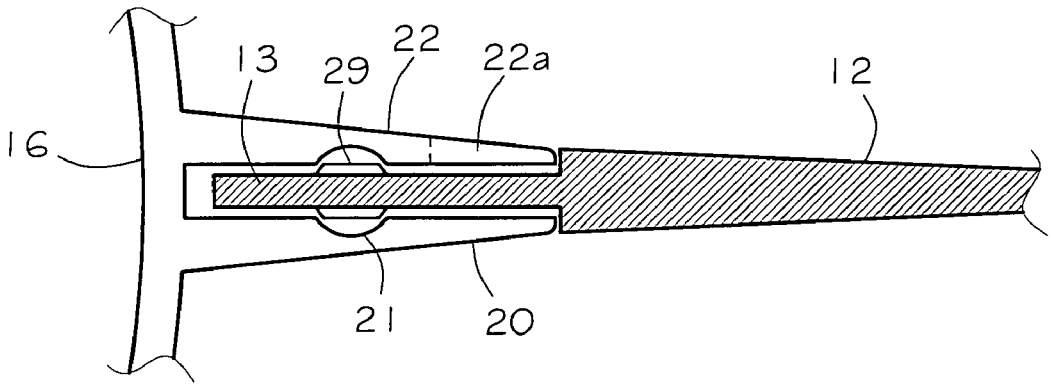
FIG. 5 is a lateral cross-section illustration of the foldable deployable wing illustrated in FIG. 1.

FIG. 5 is a lateral cross-section illustration of the foldable deployable panel illustrated in FIG. 1 showing the wing in a deployed (erect) state.

Figure 6:
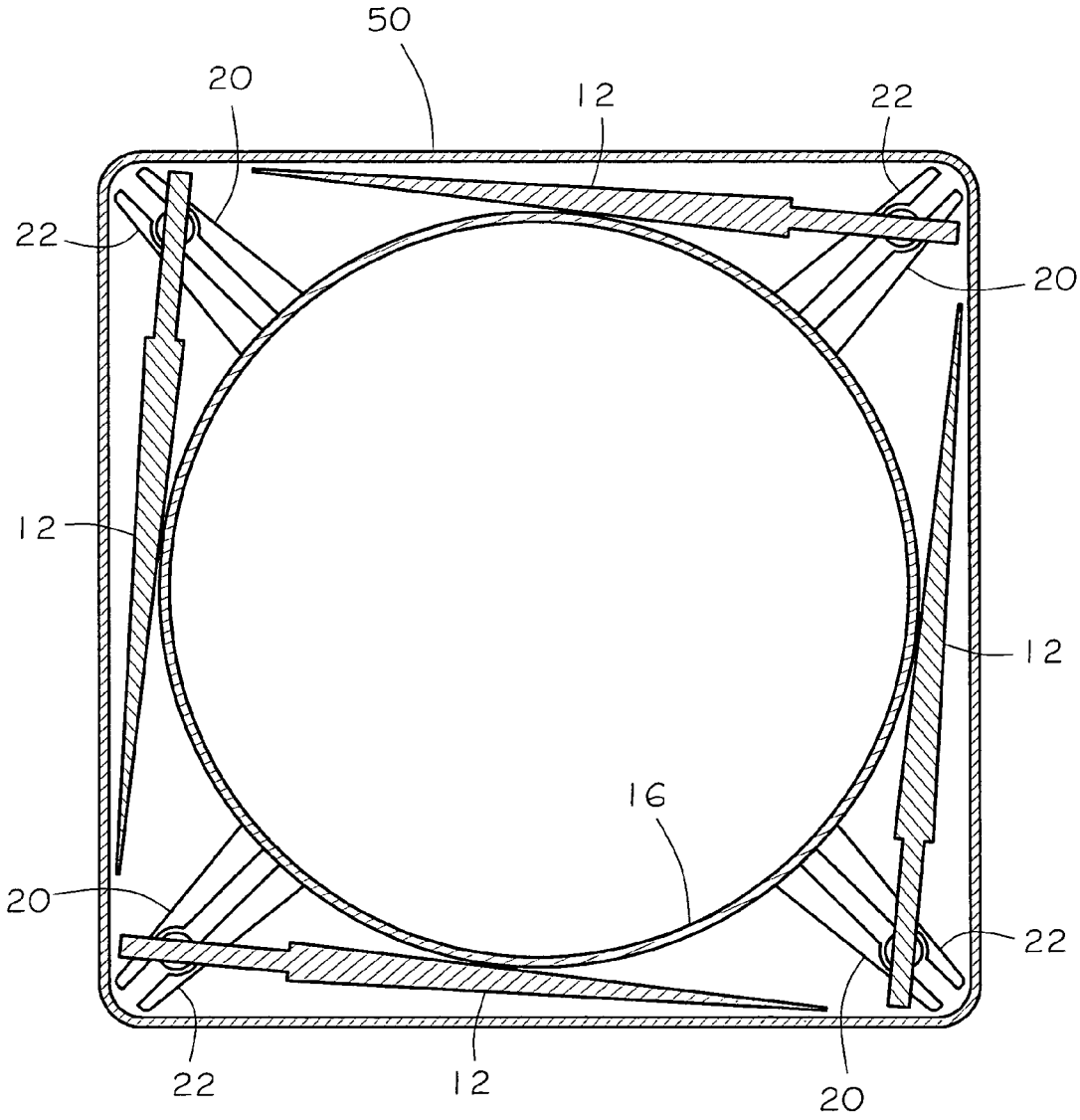
FIG. 6 is a cross-section illustration of a projectile with four foldable deployable wings in accordance with an embodiment of the present invention, in a storing position.

FIG. 6 is a cross-section illustration of a projectile 16 with four foldable deployable wings 12 in accordance with an embodiment of the present invention, in a storing position within a designated container 50. The container is designed to hold the projectile with its folded wings neatly, keeping the wings in the folded position.

The deployment of the wings is simple and swift. When the folded wings are not restrained they can be manually handled to return to the deployed state (as shown in FIG. 1).

Alternatively, the wings can assume the deployed position simply by removing the restraint that holds the wings in their folded position. The force of the spring 28, and the inclined edges 21 (see FIG. 3) of support plates 20 and 22, which by default favor sliding of the wings back into the confinement of support plates, act to together restore the wings deployed state. In order to have an illustration of the deployment the figures ought to be considered in reversed order (FIG. 3, then FIG. 2 and then FIG. 1).

In an embodiment of the present invention a springs mechanism 28 stores the energy needed (until it hits its stopper, designated 22A in FIG. 1 and FIG. 2) for the torque needed for convenient deployment of the wings.

In the first turn which turns the wing along the projectile main body with respect to hinges, uses the spring as a torsion-spring device. In the second turn which turns the wing to extend from the projectile main body uses the same spring as a tension-spring, exerting torque on the wing with respect to hinge 34.

In an alternative embodiment of the present invention the projectile with the folded wings, according to an embodiment of the present invention is provided with a removable fastener, holding the wings in their folded state. When the fastener is removed or released the wings deploy.

Such a fastener may include a time dependent release mechanism or other automatic or remote-controlled release mechanism to ensure proper and timely deployment of the wings.

In another embodiment of the present invention, panels of devices such as, but not limited to, sun-energy collectors and various broadcasting and reception antennas are folded and deployed in a manner that was previously described for wings of projectiles but instead of having a spring mechanism (designated 28 in FIG. 1 and FIG. 2) that have a default state that favors sliding of a wing (No. 12 In FIG. 1) back into the confinement of support plates (designated 20 and 22 in FIG. 4 and FIG. 5) another "energy-storing" element such as a hydraulic or pneumatic mechanism slides a panel back into the confinement of support plates.

In another embodiment of the present invention, panels are folded and deployed in a manner that was previously described for wings of projectiles but instead of having an auxiliary flap (Numbered 36 in FIG. 1 and FIG. 2) a plate or bar has a pin (designated 40 in the Figures) that inserts into a corresponding bore (No. 42 in the Figures) in the deployed panel.

In another embodiment of the present invention, a panel is coupled in a position substantially parallel along the adjacent body to which it is attached, to a side-by-side configuration with the body (as illustrated in FIG. 2). The folding and deployment of the panel is done by turning of the panel about an axis parallel to the adjacent body, bringing the broad surface of the panel to a tangential stored position with respect to the body external surface (illustrated in FIG. 3).

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

The invention claimed is:

1. A foldable deployable panel device attached to a body of an object, the device comprising:

a panel pivotally attached to the body by a first pivot element at a first pivot position defining a first turning axis and a second pivot element at a second pivot position defining a second turning axis that is substantially perpendicular to the first turning axis, wherein the first pivot element is disengageable from the first pivot position, when the panel is aligned in a predetermined orientation, and wherein the second pivot element is fixed at the second pivot position, when the first pivot element is engaged at the first pivot position, and wherein the panel is urged by an energy storing element, when the first pivot element is disengaged from the first pivot position, to move into a deployed position.

2. The device as claimed in claim 1, wherein the panel is selected from a group of 10 panels including: a wing, a solar panel, an antenna.

3. The device as claimed in claim 1, wherein the energized element comprises a spring.

4. The device as claimed in claim 3, wherein the spring is connected at one end to the second pivot element and at another end to the body.

5. The device as claimed in claim 4, wherein the second pivot element fits into a matching bore when engaged in the second pivot position.

6. The device as claimed in claim 5, wherein the matching bore is provided in a support member comprising two plates in between which a portion of the panel is located when in the deployed state.

7. The device as claimed in claim 1, wherein a support member is provided for supporting the panel in the deployed state.

8. The device as claimed in claim 7, wherein a protrusion is provided on one of the support plates to limit movement of the panel preventing it from crossing over the support plate with the protrusion.

9. The device as claimed in claim 7, wherein the support member comprises two substantially parallel plates projecting from the body, confining a proximal portion of the panel.

10. The device as claimed in claim 9, wherein the support plates comprise inclined top edges.

11. The device as claimed in claim 1, further provided with a fastener for fastening the panel to the body.

12. The device as claimed in claim 11, wherein the fastener is provided with a release mechanism.

13. The device as claimed in claim 12, wherein the release mechanism is selected from a group of release mechanisms including: time-dependent mechanism, remote- 20 controlled mechanism, time-delay mechanism.

14. The device as claimed in claim 1, further comprising a locking mechanism for locking the panel in a deployed state.

15. The device as claimed in claim 14, wherein the locking mechanism comprises a snap-lock.

16. A projectile or flying object comprising: a body;

a plurality of panels, each panel pivotally attached to the body by a first pivot element at a first pivot position defining a first turning axis and a second pivot element at a second pivot position defining a second turning axis that is substantially perpendicular to the first turning axis, wherein the first pivot element is disengageable from the first pivot position, when the panel is aligned in a predetermined orientation, and wherein the second pivot element is fixed at the second pivot position, when the first pivot element is engaged at the first pivot position, and wherein the panel is urged by an energy storing element, when the first pivot element is disengaged from the first pivot position, to move into a deployed position.

17. The object as claimed in claim 16, wherein the panels are selected from a group of panels including: wings, solar panels and antennas.

18. The object as claimed in claim 16, provided with a container for storing the object when the panels are in a folded storing state.

19. The object as claimed in claim 16, wherein the energized element comprises a spring.

20. The object as claimed in claim 19, wherein the spring is connected at one end to the second pivot element and at another end to the body.

21. The object as claimed in claim 20, wherein the second pivot element fits into a matching bore when engaged in the second pivot position.

22. The object as claimed in claim 21, wherein the matching bore is provided in a support member comprising two plates in between which a portion of the panel is located when in the deployed state.

23. The object as claimed in claim 16, wherein a support member is provided for supporting the panel in the deployed state.

24. The object as claimed in claim 23, wherein the support member comprises two substantially parallel plates projecting from the body, confining a proximal portion of the panel.

25. The object as claimed in claim 24, wherein the support plates comprise inclined top edges.

26. The object as claimed in claim 16, further provided with a fastener for fastening the panel to the body.

27. The object as claimed in claim 26, wherein the fastener is provided with a release mechanism.

28. The object as claimed in claim 27, wherein the release mechanism is selected from a group of release mechanisms including: time-dependent mechanism, remote-controlled mechanism, time-delay mechanism.

29. The object as claimed in claim 16, further comprising a locking mechanism for locking the panel in a deployed state.

30. The object as claimed in claim 29, wherein the locking mechanism comprises a snap-lock.

* * * * *